United States Patent [19]

Flemings et al.

[11] 4,108,643

[45] Aug. 22, 1978

[54] METHOD FOR FORMING HIGH FRACTION SOLID METAL COMPOSITIONS AND COMPOSITION THEREFOR

[75] Inventors: Merton C. Flemings, Cambridge; Rodney G. Riek, Reading; Kenneth P. Young, Arlington, all of Mass.

[73] Assignee: Massachusetts Institute of Technology, Cambridge, Mass.

[21] Appl. No.: 725,903

[22] Filed: Sep. 22, 1976

[51] Int. Cl.[2] ..... C22B 4/00; C22C 1/02; C22C 33/00

[52] U.S. Cl. ..... 75/135; 75/10 R; 75/65 R; 75/129

[58] Field of Search ..... 75/130 R, 135, 10 R, 75/65 R

[56] References Cited

U.S. PATENT DOCUMENTS

| | | | |
|---|---|---|---|
| 3,936,298 | 2/1976 | Mehrabian et al. | 75/135 |
| 3,948,650 | 4/1976 | Flemings et al. | 75/135 |
| 3,951,651 | 4/1976 | Mehrabian et al. | 75/135 |

OTHER PUBLICATIONS

Van Cleave, "Stirring Action Opens Up Steel Die Casting," Iron Age, pp. 34–35 (Aug. 22, 1977).

*Primary Examiner*—P. D. Rosenberg
*Attorney, Agent, or Firm*—Arthur A. Smith, Jr.; Paul J. Cook

[57] ABSTRACT

A metal composition characterized by greater than about 65 weight percent degenerate denritic or nodular primary discrete solid particles suspended in a secondary phase having a lower melting point than the primary particles and which secondary phase can be solid or liquid. The method involves raising the temperature of a metal alloy to a value at which the alloy is largely or completely in the molten state. The melt is then subjected to vigorous agitation in an apparatus having an inner surface contacting the liquid-primary solid composition that is not wet by the composition and the heat is extracted to increase the portion of the mixture is in solid degenerate dendrite or nodular form greater than about sixty-five percent while continuing the agitation.

37 Claims, 3 Drawing Figures

26
28
6
6
8
8
10
10
30
12
16
16
14
18
40
40
20
42
42
38
44

METHOD FOR FORMING HIGH FRACTION SOLID METAL COMPOSITIONS AND COMPOSITION THEREFOR

BACKGROUND OF THE INVENTION

This invention described herein was made in the course of work performed under Contract No. DAAG 46-73-C-0110 with the Department of the Army.

This invention relates to a method for making metal compositions containing high concentrations of degenerate dendrites and to the compositions produced therefrom.

Prior to the present invention, metal compositions have been made containing up to about 65 weight percent degenerate dendrites. Such compositions and their method of preparation are described in U.S. Pat. Nos. 3,948,650, issued Apr. 6, 1976 to Flemings et al and 3,954,455, issued May 4, 1976 to Flemings et al. As described by these patents, a metal alloy is heated to form a liquid-solid mixture which is vigorously agitated to convert the dendrites derived from the alloy to degenerate dendrites. These compositions can be cast directly or can be solidified and subsequently reheated to form a thixotropic composition which can be cast directly. Substantial advantages are attained when casting the composition since the mold is not exposed to the heat of fusion of the material solidified prior to casting. Furthermore, the cast material experiences far less shrinkage upon solidification as compared to total liquid compositions and therefore the final cast article exhibits far less solidification shrinkage as compared to an article cast from a totally liquid metal composition.

U.S. Pat. Nos. 3,951,651, issued Apr. 20, 1976 to Mehrabian et al and 3,936,298, issued Feb. 3, 1976 to Mehrabian et al each disclose a method for modifying the degenerate dendrite-containing composition by adding thereto third phase particles of a surface composition that is not wet by the metal composition containing liquid and degenerate dendrites in which the resultant composition can contain up to 65 weight percent degenerate dendrites. U.S. Pat. No. 3,902,544, issued Sept. 2, 1975 to Flemings et al discloses a continuous process for forming the degenerate dendrite-containing compositions which contain up to about 65 weight percent degenerate dendrites.

The metal compositions described in the cited patents provide substantial advantages over the prior art, particularly in casting processes. However, it would be desirable to provide a means for providing new compositions containing more than about 65 weight percent degenerate dendrites and which are formable so that more of the heat of fusion can be removed from the composition prior to forming, thereby extending the life of the forming apparatus and providing formed materials that exhibit even less solidification shrinkage.

SUMMARY OF THE INVENTION

The present invention provides a process for forming a metal composition containing degenerate dendrites in a concentration greater than about 65 weight percent to an upper limit of primary solids which depends upon particle size, shear rate, composition and cooling rate usually up to about 85 weight percent. The upper limit of primary solids depends upon the size of the primary solids and the composition and is reached when the liquid phase ceases to be continuous so that the primary solids no longer slide along their boundaries and wherein there is sufficient fusion of the primary solids to each other which prevents the solids from sliding along their boundaries when the composition is subjected to shear forces. These compositions may contain third phase particles having surfaces which may or may not be wet by the liquid portion of the metal composition from which the degenerate dendrites are formed. The metal compositions are formed by raising the temperature of an alloy to-be-cast to a value at which the alloy is in the liquid state and is in a liquid-solid state and vigorously agitating the composition thereby formed. The heat is then extracted from the melt while agitation continues to increase the fraction solid comprising discrete degenerate dendrites or nodules while avoiding the formation of a dendritic network. It has been found that by forming the walls of the agitation zone of a material that is not wet by the liquid-solid metal alloy, metal compositions having much higher weight percent degenerate dendrites than was previously obtainable can be recovered directly from the agitation zone. Apparent viscosity of the liquid-solid mixture is continuously monitored and the measurement is used to control the residence time of the liquid-solid mixture in the agitation zone wherein heat is extracted. In addition, pressure differential in the agitation zone can be utilized to augment maintainance of the continuous flow of the metal composition through the agitation zone. The compositions can be cast or formed or can be cooled to effect complete solidification for storage and later use. These compositions provide substantial advantage in that the great majority of the heat of fusion is removed therefrom prior to casting or forming and the shrinkage of the cast or formed metal composition is greatly reduced so that it is insignificant.

DESCRIPTION OF SPECIFIC EMBODIMENTS

This invention provides a metal composition which can be either solid or partially solid and partially liquid and which comprises primary solid discrete particles and a secondary phase. The secondary phase is solid when the metal composition is solid and is liquid when the metal composition is partially solid and partially liquid. These compositions can be formed from a wide variety of metals or metal alloy compositions. The primary particles comprise small degenerate dendrites or nodules which are generally spheroidal in shape and are formed as a result of agitating the melt when the secondary phase is liquid. The primary solid particles are made up of a single phase or plurality of phases having an average composition different from the average composition of the surrounding matrix, which matrix can itself comprise primary and second phases upon further solidifications.

By the term "primary solid" as used herein is meant the phase or phases solidified to form discrete degenerate dendrite particles as the temperature of the melt is reduced below the liquidus temperature of the alloy into the liquid-solid temperature range prior to casting the liquid-solid slurry formed. By the term "secondary solid" as used herein is meant the phase or phases that solidify from the liquid existing in the slurry at a lower temperature than that at which the primary solid particles are formed after agitation ceases. The primary solids obtained in the composition of this invention differ from normal dendrite structures in that they comprise discrete particles suspended in the remaining liquid matrix. Normally solidified alloys, in absence of agitation, have branched dendrites separated from each other in the early stages of solidification, i.e., up to 15 to 20 weight percent solid, and develop into an interconnected network as the temperature is reduced and the weight fraction solid increases. The structure of the composition of this invention on the other hand prevents formation of the interconnected network by maintaining the discrete primary particles separated from each other by the liquid matrix even up to solid fractions of about 85 weight percent or above. The primary solids are degenerate dendrites in that they are characterized by having smoother surfaces and less branched structures which approach a spherical configuration than normal dendrites and may have a quasi-dendritic structure on their surfaces but not to such an extent that interconnection of the particles is effected to form a network dendritic structure. The primary particles may or may not contain liquid entrapped within the particles during particle solidification depending upon severity of agitation and the period of time the particles are retained in the liquid-solid range. However, the weight fraction of entrapped liquid is less than that existing in a normally solidified alloy at the same temperature employed by present processes to obtain the same weight fraction solid.

The secondary solid which is formed during solidification from the liquid matrix subsequent to forming the primary solid contains one or more phases of the type which would be obtained during solidification of a liquid alloy of identical composition by presently employed casting processes. That is, the secondary solid can comprise dendrites, single or multiphase compounds, solid solutions or mixtures of dendrites, compounds and/or solid solutions.

The size of the primary particles depends upon the alloy or metal compositions employed, the temperature of the solid-liquid mixture and the degree of agitation employed with larger particles being formed at lower temperature and when using less severe agitation. Thus, the size of the primary particles can range from about 1 to about 10,000 microns. It is preferred that the composition contain as high a weight percent primary particles as possible, consistent with a viscosity which promotes ease of casting or forming while minimizing heat damage to the forming or casting apparatus.

In accordance with the process of this invention to obtain metal compositions having degenerate dendrites above about 65 weight percent, the vigorous agitation of the metal composition is conducted in an agitation zone formed with a material that is not wet by the metal composition and which is both chemically stable to the metal composition and is thermally stable. The surface in the agitation zone is not wet by the liquid-solid mixture such that there is no appreciable adhesion between the liquid-solid mixture and the surface of the agitation zone. Thus, for example, high density recrystallized alumina is not wet by ferrous metals, particularly steels. Furthermore, it is not degraded by ferrous metals such as steels. Therefore, the high density alumina is an ideal material used to form ferrous metal compositions having high concentrations of degenerate dendrites. Other examples of materials which are not wet include graphite with aluminum alloy and stainless steel with tin-lead alloy. In addition, the composition being vigorously agitated can be subjected to a pressure differntial within the agitation zone to augment flow of the liquid-solid metal composition through the agitation zone. This can be accomplished by forming a metallostatic head of liquid or semi-liquid metal above the agitated metal composition and/or by pressurizing the surface of the metal composition above the agitated metal composition or by reducing the pressure at the outlet of the agitation zone.

In order to obtain the composition of this invention, it has been found essential to utilize a material to form the interior of the agitation zone which is not wet by the agitated metal composition. Since the rate of viscosity change as a function of solids content of the liquid-solid composition increases sharply with increase in fraction primary solids at high fractions of primary solids, clogging of the agitation zone with the high fraction solid material which cannot be overcome solely by increasing shear forces frequently occurs in agitation zones formed from material that is wet by the liquid-solid metal composition. As a result of the high rate of viscosity change in the agitation zone with increases in fraction primary solids at high fraction primary solids composition of this invention, it is necessary to provide a viscosity sensor which measures viscosity directly or an analog of viscosity to control the shear forces, metal flow rate (metal residence time in the agitation zone) and/or cooling rate in the agitation zone to maintain the high fraction solids in the metal composition being formed. One convenient method for providing the measurement is to provide a constant speed electrical motor to rotate the agitator and to measure the current needed to drive the motor at a constant speed. When the needed current is greater than desired indicating a fraction primary solids higher than desired, fraction primary solids in the agitation zone is reduced either by increasing metal flow rate through the agitation zone and/or by reducing the cooling rate in the agitation zone. When the current is less than desired indicating a fraction primary solids lower than desired, fraction primary solids in the agitation zone is increased either by reducing metal flow rate through the agitation zone and/or by increasing cooling rate in the agitation zone. Care also must be taken when processing metals which form slag in air, such as steels, to shield the agitation zone outlet with an inert gas to prevent clogging of the agitation zone.

The compositions of this invention can be formed from any metal alloy system or pure metal regardless of its chemical composition. Even though pure metals and eutectics melt at a single temperature, they can be employed to form the composition of this invention since they can exist in liquid-solid equilibrium at the melting point by controlling the net heat input or output to the melt so that, at the melting point, the pure metal or eutectic contains sufficient heat to fuse only a portion of the metal or eutectic liquid. This occurs since complete removal of heat of fusion in a slurry employed in the casting process of this invention cannot be obtained instantaneously due to the size of the casting normally used and the desired composition is obtained by equating the thermal energy supplied, for example by vigorous agitation and that removed by a cooler surrounding enviroment. Representative suitable alloys include magnesium alloys, zinc alloys, aluminum alloys, copper alloys, iron alloys, nickel alloys, cobalt alloys and lead alloys such a lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super-alloys such as nickel-iron alloys, nickel-iron-cobalt-chromium alloys and cobalt-chromium alloys or pure metals such as iron, copper or aluminum.

This invention will now be discussed upon reference to accompanying drawings, in which.

Figure 1:
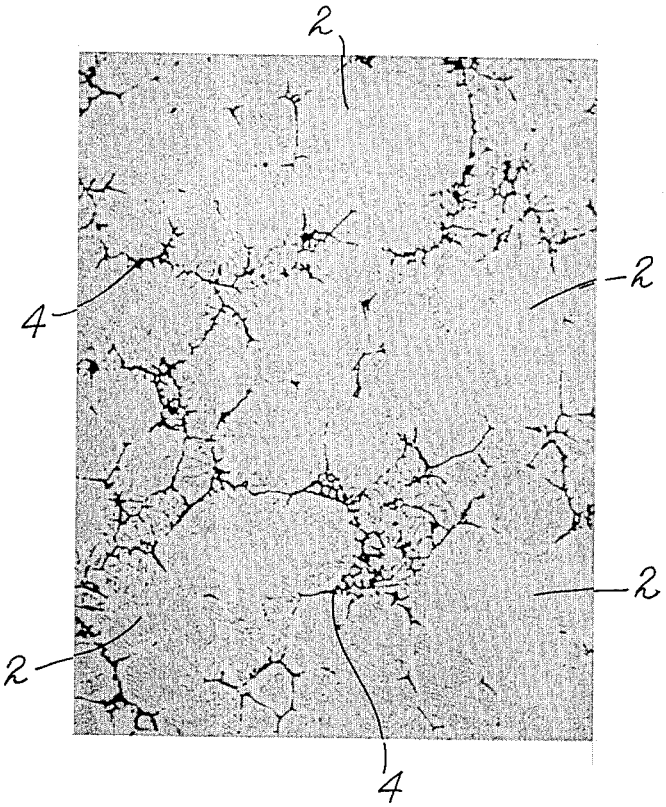
FIG. 1 is a reproduction of a photomicrograph showing the structure of an AISI 304 stainless steel semi-solid slurry.

Referring to FIG. 1, the AISI 304 stainless steel was agitated in a zone having a rotor with a square cross section and wherein the interior surface of the agitation zone was formed of a high density recrystallized alumina sleeve. The liquid-solid steel was formed continuously at a flow rate of about 1 lb/min and was cooled to a temperature of about 1420° C in the agitation zone. The resultant composition was about 75 weight percent primary solids 2 and about 25 weight percent secondary solids 4.

Figure 2:
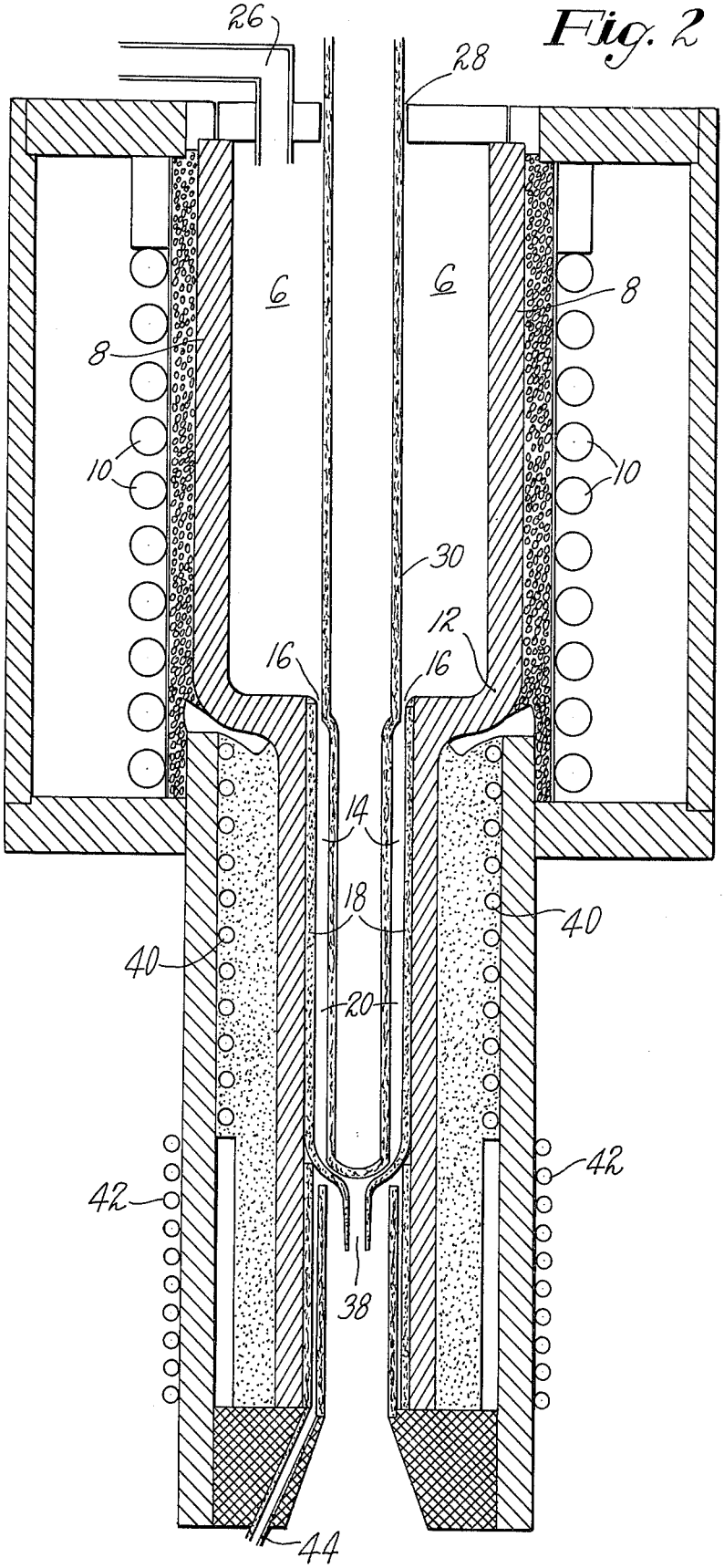
FIG. 2 is a cross-sectional view of an agitation zone utilized in the present invention.

Referring to FIG. 2, an apparatus useful in forming high fraction primary solids stainless steel is illustrated. A stainless steel in the liquid state 6 is retained in container 8. The stainless steel 6 can be heated conveniently to the liquidus state or maintained at or above the liquidus temperature by means of induction heating coils 10 which surround the container 8. The container 8 is graphitized alumina which is resistant to corrosion by the stainless steel 6. Container 8 is provided with an opening 16 to communicate with agitation zone 14. Agitation zone 14 is provided with a sleeve 18 comprising high density recrystallized alumina which is thermally stable and chemically stable to the liquid-solid stainless steel composition 20 in zone 14 and is not wet by the liquid-solid stainless steel. A blanket of inert gas, e.g. argon is vented through inlet 26 to protect the liquid stainless steel 6 from oxidation. The excess inert gas is vented through the opening 28 which surrounds agitator 30. The horizontal cross-section of the agitator is circular while the horizontal cross-section of the agitator 32 is square so that the shear forces on the liquid-solid composition 20 is higher than on the liquid composition 6. Agitation zone 14 is provided with an outlet 38 and is surrounded by cooling coil 40 which is operated to remove heat from the stainless steel to form a liquid-solid composition above about 65 weight percent primary solids. Coil 42 functions to maintain the desired temperature at the outlet 38 sufficiently high to prevent clogging at the outlet 38. In order to prevent slag formation at the outlet 38 by virtue of oxidation due to contact with air, an inert or reducing gas, e.g. argon, 4% hydrogen, is introduced through inlet 44 to surround outlet 38 and prevent steel oxidation until after the liquid-solid steel has been recovered.

Figure 3:
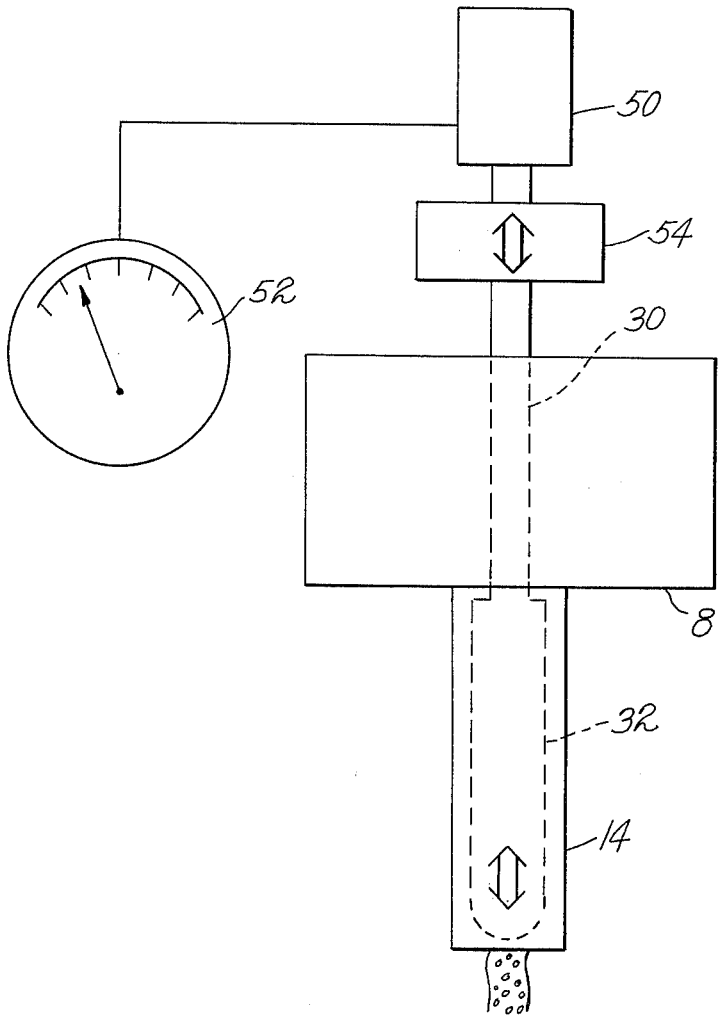
FIG. 3 is an elevation view, schematic in form, of an apparatus adapted to practice the methods herein disclosed.

The operation of the apparatus of FIG. 2 will be described with reference to FIG. 2 and FIG. 3. Stainless steel is introduced into zone 8 wholly molten, partially solidified or wholly solid. In any event, the stainless steel is rendered molten in zone 8 by heat induction coils 10. The molten steel flows into zone 14 while agitators 30 and 32 are rotated by constant speed motor 50. In zone 14, the steel is cooled by coil 40 into the liquid-solid range above 65 weight percent solids. The apparent viscosity of the liquid-solid steel 20 is sensed by ammeter 52 which measures the current required to drive the motor 50 at a constant speed. The size of outlet 38 is regulated by valve controller 54 which functions to raise or lower agitators 30 and 32 in response to the reading on ammeter 52. When the current reading, i.e., apparent viscosity, is too high, valve controller 54 raises agitators 30 and 32 to enlarge outlet 38 and increase flow rate of liquid-solid steel through zone 14. When the current reading is too low, agitators 30 and 32 are lowered to reduce the size of outlet 38, thereby increasing the residence time of the steel in zone 14 and thereby increasing primary solid content of the steel to the desired fraction primary solid above 65 weight percent. The liquid-solid steel is not wet by the recrystallized high density alumina 18 and passes through outlet 38 to recovery (not shown) such as by being cast. It has been found that by monitoring apparent viscosity, the primary solids content of the steel above 65 weight percent can by easily controlled as opposed, for example by regulating residence time in zone 14 by monitoring temperature which involves a time lag or thermal response time so that solids content cannot be regulated immediately. With thermal regulation, there is an undesirably high incidence of solidification to an extent where rotation of the agitators 30 and 32 cannot be easily maintained and metal clogging results.

The liquid-solid mixture can, when the desired ratio of liquid-solid has been reached, be cooled rapidly to form a solid for easy storage. Later, the solid can be raised to the temperature of the liquid-solid mixture, for the particular ratio of interest, and then cast or otherwise formed, as before, using usual techniques. Metals or alloys prepared according to the procedure just outlined possess thixotropic properties. It can thus, be fed into a modified die casting machine or other apparatus in apparently solid form. However, shear resulting when this apparently solid metal or alloy is forced into a die cavity causes the semi-solid to transform to a material whose properties are more nearly that of a liquid. A metal or alloy having thixotropic properties also can be obtained by cooling the liquid-solid mixture to a temperature higher than that at which all of the liquid solidifies and the composition obtained can be formed to shape. This technique can be effected even with metal compositions containing up to about 85 weight percent degenerate dendrites.

Liquid-solid mixtures were prepared employing apparatus like that shown in FIG. 2 and at speeds of 800 RPM for the rotor. The temperature of the liquid-solid at 75 percent solid for various alloys formed by the present invention is given below:

Sn - 10% Pb: 192° C
AISI 440 C stainless steel: 1392° C
Copper Alloy 905: 911° C
Ni base Superalloy Udimet 700: 1300° C Variations up or down from the 75 percent primary solid-liquid mixture will result from changes in the temperature values given.

A casting made using a 25 percent liquid 75 percent degenerate dendrite solid mixture has a solidification shrinkage of about 25 percent of a casting made from wholly liquid metal. Solidification shrinkages of some metals are: iron 4.0 percent; aluminum 6.16 percent; and copper 4.9 percent.

Forming of the partially solidified metal slurry or mixture herein disclosed can be effected by pouring, injection or other means; and the process disclosed is useful for die casting, permanent mold casting, continuous casting, closed die forging, hot pressing, vacuum forming (of that material) and others. The special properties of these slurries suggest that modifications of existing casting and forming processes might usefully be employed. By way of illustrations, the effective viscosity of the slurries can be controlled by controlling fraction of primary solid, particle size and shape and shear rate; the high viscosities possible when the instant teachings are employed, result in less metal spraying and air entrapment in casting processes. Furthermore, more uniform strength and more dense articles result from the present method.

The means by which agitation is effected, as shown in FIG. 2 and as before discussed, is a rotor, but electromagnetic stirring, gas bubbling and other agitation-inducing mechanisms can be employed so long as the agitation is sufficient to prevent the formation of interconnected dendritic networks or to substantially eliminate or reduce dendritic branches already formed on the primary solid particles.

In one aspect of the present invention, a metal-metal or metal-nonmetal composite composition is provided which comprises a metal or metal alloy matrix containing third phase solid particles homogeneously distributed within the matrix and having a composition different from the metal or metal alloy. The third phase particles are incorporated into the slurry compositions of this invention by adding them to the slurry and agitating the resulting composition until the third phase particles are dispersed homogeneously. The particles added as third phase particles to the slurry have a surface composition that may or may not be wet by the liquid portion of the metal to which it is added to effect its retention homogeneously within the metal matrix. As employed herein, a composition that is wet refers to compositions which, when added to a metal or metal alloy at or slightly above the liquidus temperature of the metal or metal alloy and mixed therein, as by agitation with rotating blades, for a suitable period of time to effect intimate contact therewith, e.g. about 30 minutes, are retained in measurable concentrations within the liquid after agitation thereof has ceased and the resultant composition is allowed to return to a quiescent state when the metal or metal alloy is at or slightly above the liquidus temperature. When third phase particles are incorporated into a metal or metal alloy which wets the particles at the liquidus temperature of the metal or metal alloy, the particles are retained therein in concentrations from a measurable concentration of slightly above 0 percent by weight, and generally up to about 5 percent by weight. Representative examples of wetting comprises a system including nickel-coated graphite in aluminum alloys, as disclosed by U.S. Pat. No. 3,600,163 and tungsten carbide in aluminum, magnesium or zinc as disclosed by U.S. Pat. No. 3,583,471. These patents are incorporated herein by reference. In some cases, the concentration of third phase particles can be up to about 30 percent by weight. Representative examples of solid particles that are not wet by certain metal compositions include graphite, metal carbide, sand, glass, ceramics, metal oxides such as thorium oxide, pure metals and alloys, etc.

In the present invention, the third phase particles can be added to the slurry composition in concentrations up to about 30 weight percent. The metal or metal alloy can be solid or partially solid and has up to about 85 weight percent of a structure comprising degenerate dendritic or nodular primary discrete solid particles suspended in a secondary phase having a lower melting point than the primary particles which secondary phase can be solid or liquid. These compositions are formed by heating a metallic composition to a temperature at which most or all of the metallic composition is in a liquid state, and vigorously agitating the composition to convert any solid particles therein to degenerate dendrites or nodules having a generally spheroidal shape. Solid particles comprising the third phase of the composition are added to the liquid-solid metallic composition after all or a portion of the primary solids have been formed and the third phase particles are dispersed within the metal composition such as by agitation. After the third phase particles have been dispersed in the metallic composition, the melt can be cast to a desired form, or can be cooled to form a composition which can be formed or cast subsequently by heating and shaping. In any case, the final formed composition contains primary solids.

The composition of this invention containing third phase particles can be formed from a wide variety of metals or alloys as set forth above in combination with nonmetallic or metallic third phase particles. The composition contains a secondary phase which can be either solid or liquid and a third phase which is solid, which third phase has a composition different from the primary solid particles and the secondary phase. The secondary phase is solid when the metal compostion is solid and liquid when the metal composition is partially liquid.

The third phase of the compositions of this invention is formed by the solid particles which are added to the primary solid-secondary liquid phase slurry. For purposes of this invention, the composition of the particles forming the third phase can include any solid composition which normally is added to metal alloy compositions to change one or more physical characteristics of the metal alloy composition.

The weight percent of particles forming the third phase particles that can be added to a metal alloy can be varied widely. Higher weight percent of third phase particles can be added when the weight percentage of primary solids is relatively low. However, the primary particles should not be so small or widely distributed in the secondary phase as to present substantially no interaction with the third phase particles added. Generally, the primary particles should be present in the alloy in amounts of at least 65 weight percent and can vary up to about 85 weight percent.

During the particle addition step, the particles are added up to the capacity for the secondary phase to retain them and/or up to a weight fraction where the total weight fraction primary particles and third phase particles can be as high as about 95 weight percent. This capacity of retention of the third phase particles by the secondary phase is exceeded when the particles are observed to begin floating to the melt surface or sinking to the bottom of the melt. The formation of additional liquid subsequent to the third phase particles addition does not effect the removal of the previously added third phase particles since they have had time to become wet by the secondary liquid phase and/or to interact with the primary particles present therein so that they are retained in the metal composition. By operating in this manner, it is possible to attain up to about 30 weight percent third phase particle addition into the metal alloy. The preferred concentration of third phase particles depends upon the characteristics desired for the final metal composition and thus depends upon the metal alloy and particle compositions. The third phase particles are of a size which promotes their admixture to form homogeneous compositions and preferably of a size of between 1/100 and 10,000 microns.

It is desirable to attain uniform distribution of the third phase particles which can be controlled by increasing the degree and duration of mixing, employing relatively low rates of addition of the third phase particles and by controlling the weight percent of third particles added to the metal for a given weight percent of primary solids in the metal.

When the desired composition has been formed, which consists of primary solid-secondary liquid-third phase particles, it can be cooled to form a solid for easy storage. Later the solid can be heated to a temperature wherein a primary solid-secondary liquid-third phase particle mixture is attained. Furthermore, a solid can be prepared which possesses thixotropic properties when reheated to the liquid-solid state. It can, thus be fed into a modified die casting machine or other apparatus in apparently solid form. However, shearing resulting when this apparently solid composition is forced into die cavity causes the composition to transform to a metal alloy whose properties are more nearly that of a liquid thereby permitting it to be shaped in conformance to the die cavity. A composition having thixotropic properties also can be obtained by cooling the primary solid-secondary liquid-third phase particle composition to a temperature higher than that at which all of the secondary liquid solidifies and the thixotropic composition obtained can be cast.

Alternatively, casting can be effected directly after the third phase particles have been successfully added to the primary solid-liquid mixture by pouring, injection or other means. The process disclosed is useful for die casting, mold casting, continuous casting, closed die forging, hot pressing, vacuum forming and other forming processes. The effective viscosity of the compositions therein and the high viscosity that can be obtained with the compositions of this invention result in less metal spraying and air entrapment in die casting and permits higher metal entrance velocities in this casting process. Furthermore, more uniform strength and more dense castings result from the present method.

We claim:

1. The method for forming a metal composition having solid discrete degenerate dendrites homogeneously dispersed within a liquid phase of said metal composition which comprises:

a. heating a first metal composition to form a liquid-solid mixture of said first metal composition wherein greater than about 65 weight percent up to a weight percent of primary solids where there is sufficient fusion of the primary solids to each other which prevents the primary solids from sliding along their boundaries when the mixture is subjected to shear forces, and b. vigorously agitating said liquid-solid mixture in an agitation zone to convert the solid therein to discrete degenerate dendrites derived from said first metal composition, said degenerate dendrites comprising greater than about 65 weight percent of the heated metal composition and wherein the remainder of the heated metal composition is liquid wherein the surface in said agitation zone contacting said liquid-solid mixture is stable against degradation by said liquid-solid mixture and is not wet by said liquid-solid mixture, and c. continuously monitoring the apparent viscosity or an analog of the apparent viscosity of the liquid-solid mixture thereby to control the heat extracted from said mixture to maintain the primary solids content of said mixture above about 65 weight percent.

2. The method for forming a solid metal composition containing discrete degenerate dendrites homogeneously dispersed within a secondary phase of said solid metal composition which comprises:

a. heating a first metal composition to form a liquid-solid mixture of said first metal composition wherein greater than about 65 weight percent up to a weight percent of primary solids where there is sufficient fusion of the primary solids to each other which prevents the primary solids from sliding along their boundaries when the mixture is subjected to shear forces, and b. vigorously agitating said liquid-solid mixture in an agitation zone to convert the solid therein to discrete degenerate dendrites derived from said first metal composition, said degenerate dendrites comprising greater than about 65 weight percent of the heated metal composition wherein the surface in said agitation zone contacting said liquid-solid mixture is stable against degradation by said liquid-solid mixture and is not wet by said liquid-solid mixture, and c. continuously monitoring the apparent viscosity or an analog of the apparent viscosity of the liquid-solid mixture thereby to control the heat extracted from said mixture to maintain the primary solids content of said mixture above about 65 weight percent, and d. cooling said heated composition to solidify the liquid remaining after the degenerate dendrites are formed thereby forming a solid secondary phase of said metal composition.

3. The method for shaping a metal composition which comprises:

a. forming a metal composition having solid discrete degenerate dendrites homogeneously dispersed within a liquid phase of said metal composition by:

i. heating a first metal composition to form a liquid-solid mixture of said first metal composition wherein more than about 65 weight percent primary solids up to a weight percent of primary solids where there is sufficient fusion of the primary solids to each other which prevents the primary solids from sliding along their boundaries when the mixture is subjected to shear forces, and ii. vigorously agitating said mixture in an agitation zone to convert the liquid-solid mixture therein to discrete degenerate dendrites derived from said metal composition, said degenerate dendrites comprising greater than about 65 weight percent of the heated metal composition and wherein the remainder of the heated metal composition is liquid, wherein the surface in said agitation zone contacting said liquid-solid mixture is stable against degradation by said liquid-solid mixture and is not wet by said liquid-solid mixture, b. continuously monitoring the apparent viscosity or an analog of the apparent viscosity of the liquid-solid mixture thereby to control the heat extracted from said mixture to maintain the primary solids content of said mixture above about 65 weight percent, and c. shaping the heated metal composition comprising degenerated dendrites and liquid metal.

4. The method for forming a metal composition comprising a metal alloy matrix and third phase solid particles homogeneously suspended in said matrix, said metal alloy having solid descrete degenerate dendrites homogeneously dispersed within a secondary phase of said metal alloy which comprises:

a. heating a first metal alloy to form an initial liquid-solid mixture of said first metal alloy wherein more than about 65 weight percent is primary solid up to a weight percent of primary solids where there is sufficient fusion of the primary solids from sliding along their boundaries when the mixture is subjected to shear forces, and b. vigorously agitating said liquid-solid mixture in an agitation zone to convert the solid therein to discrete degenerate dendrites comprising more than about 65 weight percent of said heated alloy and wherein the remainder of said heated metal alloy is a liquid secondary phase wherein the surface in said agitation zone contacting said liquid-solid mixture is stable against degradation by said liquid-solid mixture and is not wet by said liquid-solid mixture, and c. continuously monitoring the apparent viscosity or an analog of the apparent viscosity of the liquid-solid mixture thereby to control the heat extracted from said mixture to maintain the primary solids content of said mixture above about 65 weight percent, and d. adding solid third phase particles to said alloy comprising degenerate dendrites and liquid secondary phase, and e. dispersing said third phase particles and said degenerate dendrites homogeneously in said secondary phase, said third phase particles comprising up to about 30 weight percent of the weight of the metal alloy and third phase particles.

5. The method of claim 1 wherein step (a) is conducted by heating the first metal composition above its liquidus temperature and thereafter cooling said first metal composition to form said liquid-solid mixture.

6. The method of claim 1 wherein step (a) is conducted by heating the first metal composition to a temperature below the liquidus temperature of said first metal composition to form said liquid-solid mixture.

7. The method of claim 5 wherein the liquid-solid mixture is cooled concomitant with said vigorous agitation to increase the proportion of said degenerate dendrites.

8. The method of claim 6 wherein the liquid-solid mixture is cooled concomitant with said vigorous agitation to increase the proportion of said degenerate dendrites.

9. The method of claim 2 wherein step (a) is conducted by heating the first metal composition above its liquidus temperature and thereafter cooling said first metal composition to form said liquid-solid mixture.

10. The method of claim 2 wherein step (a) is conducted by heating the first metal composition to a temperature below the liquidus temperature of said first metal composition to form said liquid-solid mixture.

11. The method of claim 9 wherein the liquid-solid mixture is cooled concomitant with said vigorous agitation to increase the proportion of said degenerate dendrites.

12. The method of claim 10 wherein the liquid-solid mixture is cooled concomitant with said vigorous agitation to increase the proportion of said degenerate dendrites.

13. The method of claim 3 wherein step (a) is conducted by heating the first metal composition above its liquidus temperature and thereafter cooling said first metal composition to form said liquid-solid mixture.

14. The method of claim 3 wherein step (a) is conducted by heating the first metal composition to a temperature below the liquidus temperature of said first metal composition to form said liquid-solid mixture.

15. The method of claim 13 wherein the liquid-solid mixture is cooled concomitant with said vigorous agitation to increase the proportion of said degenerate dendrites prior to being cast.

16. The method of claim 14 wherein the liquid-solid mixture is cooled concomitant with said vigorous agitation to increase the proportion of said degenerate dendrites prior to being cast.

17. The method of claim 3 wherein, prior to casting, the temperature of the liquid-solid mixture is reduced to increase the fraction of solid discrete degenerate dendrites while continuing to agitate vigorously until a desired ratio of liquid to degenerate dendrites is attained such that the mixture is thixotropic, ceasing said vigorous agitation of the thixotropic composition to get the thixotropic composition and thereafter casting the thixotropic composition.

18. The process of claim 17 wherein the initial liquid-solid composition is formed by heating the first metal composition above its liquidus temperature and thereafter cooling said first metal composition.

19. The process of claim 17 wherein the initial liquid-solid composition is formed by heating the first metal composition to a temperature below the liquidus temperature of said first metal composition.

20. The method of claim 4 wherein the initial liquid-solid mixture is cooled concomitant with said vigorous agitation to increase the proportion of said degenerate dendrites prior to adding said third phase particles.

21. The method of claim 4 wherein metal alloy is cooled to solidify said secondary phase and form a solid having said degenerate dendrites and said third phase particles homogeneously distributed therein.

22. The method of claim 20 wherein said metal alloy is cooled to solidify said secondary phase and form a solid having said degenerate dendrites and said third phase particles homogeneously distributed therein.

23. The method of claim 21 wherein said solid is heated to a temperature at which the composition is thixotropic and casting said thixotropic solid.

24. The method of claim 22 wherein said solid is heated to a temperature at which the composition is thixotropic and casting said thixotropic solid.

25. A metal composition which, when frozen from a liquid state without agitation forms a dendritic structure, said composition containing discrete degenerate dendritic primary solid particles in a concentration of greater than about 65 percent by weight based upon said composition up to a weight percent of primary solids where there is sufficient fusion of the primary solids to each other which prevents the primary solids from sliding along their boundaries when the mixture is subjected to shear forces, said primary solid particles being derived from the composition and being homogeneously suspended in a secondary phase, said secondary phase being derived from the composition and having a lower melting point than said primary solid particles.

26. The composition of claim 25 wherein said secondary phase is solid.

27. The composition of claim 25 wherein said secondary phase is liquid.

28. The composition of claim 25 wherein said secondary phase and said primary solid comprise a thixotropic composition.

29. The composition of claim 25 which is a metal alloy.

30. The composition of claim 26 which is a metal alloy.

31. The composition of claim 27 which is a metal alloy.

32. The composition of claim 28 which is a metal alloy.

33. A metal composition comprising a metal alloy containing discrete degenerate dendritic primary solid particles in a concentration of greater than 65 percent weight based upon said alloy up to a weight percent of primary solids where there is sufficient fusion of the primary solids to each other which prevents the primary solids from sliding along their boundaries when the mixture is subjected to shear forces, said primary solid particles being derived from the alloy and being suspended homogeneously in a secondary phase, said secondary phase being derived from the alloy and having a lower melting point than said primary solid particles, said secondary phase containing tertiary phase solid particles homogeneously dispersed in said secondary phase, said tertiary phase particles having a different composition from said primary particles and said secondary phase.

34. The composition of claim 33 wherein said secondary phase is solid.

35. The composition of claim 33 wherein said secondary phase is liquid.

36. The composition of claim 33 wherein the composition is thixotropic.

37. The method of claim 2 wherein said cooled solid is heated to a temperature at which the composition is thixotropic and shaping said thixotropic solid.

* * * * *